US005906508A

United States Patent [19]

Jeffcoat

[11] Patent Number: 5,906,508

[45] **Date of Patent: *May 25, 1999**

[54] ELECTRICAL DISCONNECT FOR USE WITH AN APPLIANCE

[75] Inventor: Walter Jeffcoat, Vidalia, Ga.

[73] Assignee: Thomas & Betts Corporation, Memphis, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,720

[22] Filed: Dec. 18, 1996

[51] Int. Cl.[6] ..... H01R 31/08

[52] U.S. Cl. ..... 439/509; 439/189; 200/308

[58] Field of Search ..... 439/509, 510, 439/511, 513, 189; 200/308, 43.16

[56] References Cited

U.S. PATENT DOCUMENTS

| | | | |
|---|---|---|---|
| 3,594,709 | 7/1971 | Woertz | 439/511 |
| 3,628,097 | 12/1971 | Kobryner | 439/517 |
| 4,171,861 | 10/1979 | Hohorst | 439/513 |
| 4,283,100 | 8/1981 | Griffin et al. | 439/510 |
| 4,316,999 | 2/1982 | Nattel | 439/460 |
| 4,596,429 | 6/1986 | Gierut et al. | 439/510 |
| 4,632,479 | 12/1986 | Jacobson | 439/145 |
| 4,657,333 | 4/1987 | Anderson | 439/650 |
| 5,071,362 | 12/1991 | Martens et al. | 439/188 |
| 5,449,301 | 9/1995 | Hanna et al. | 439/510 |

*Primary Examiner*—Steven L. Stephan
*Assistant Examiner*—T. C. Patel
*Attorney, Agent, or Firm*—Hoffmann & Baron, LLP

[57] ABSTRACT

An electrical disconnect for use with an appliance includes a base assembly and a pull-out head assembly. The base assembly includes an insulative housing having isolated compartments therein. Within the compartments are mounted wire connectors for receiving load and line conductors. The head assembly includes a handle on a top surface thereof and contacts extending downwardly from a bottom surface thereof. The head assembly is selectively positionable within the base assembly so that the electrical contacts of the head assembly electrically couple the line and load conductors associated with the wire connectors. The contact of the head assembly directly contacts a side portion of the line and load wire connectors, respectively. The electrical disconnect also includes a series of wire guides associated with each wire connector. The wire guide includes a tapered opening to assist in guiding conductors into the wire connectors. All the wire connectors are enclosed in the base assembly to prevent contact with live parts in the on or off position, i.e., the head assembly inserted or removed, respectively.

18 Claims, 4 Drawing Sheets

ELECTRICAL DISCONNECT FOR USE WITH AN APPLIANCE

BACKGROUND OF THE INVENTION

1. Field of the Invention

The present invention relates to an electrical disconnect, and more particularly relates to an electrical disconnect for use with an appliance, the electrical disconnect being in the form of a pull-out switch.

2. Description of the Prior Art

Electrical disconnects for use with appliances are well known in the art. Electrical disconnects are used to provide for electrical isolation of a piece of high voltage equipment, e.g. 220 volts, locally to allow repair and maintenance procedures without risk of electrical shock. For example, such an electrical disconnect is manufactured by General Electric, of Warwick, R.I., under Model No. TFN60RCP.

One of the disadvantages of presently available electrical disconnects for use with appliances is that the electrical connection of the contacts on the pull-out portion of the switch is not a direct connection with the line and load conductors. More specifically, the wire connectors on the electrical disconnect are positioned exterior to the unit. A bus bar extends from the wire connector into the unit for engagement with a plug-type contact positioned on the pull-out portion of the electrical disconnect. Accordingly, the load and line conductors are coupled to the wire connectors and are electrically joined by the contacts on the pull-out portion of the disconnect when placed within the unit. Specifically, the contacts in the pull-out portion of the disconnect electrically mate the bus bar from the load conductors to the line conductors. Thus, it would be beneficial to reduce the number of pieces required in the base unit of the disconnect and have a direct connection between the pull-out portion of the disconnect and the wire connectors associated with the base unit.

Another disadvantage of presently available wire connectors is associated with the shielding of exposed live parts. For example, the wire connectors are positioned outside the base unit and, upon connection of the load conductors to the wire connectors, the base of the disconnect is now live. Accordingly, the possibility of electrical shock exists on contact with the exposed wire connectors. To prevent such shock hazard, presently available units include an insulative shield covering these exposed parts. However, when the shield is removed or misplaced, live parts are exposed. Accordingly, it would be beneficial to design an electrical disconnect in which no live electrical contacts are exposed to persons using the disconnect.

OBJECTS AND SUMMARY OF THE INVENTION

It is an object of the present invention to provide an electrical disconnect having a simple, easy to manufacture design.

It is another object of the present invention to provide an electrical disconnect for use with an appliance in which the contacts of the pull-out portion of the disconnect make direct contact with wire connectors positioned within a base portion of the disconnect.

It is yet a further object of the present invention to provide an electrical disconnect for use with an appliance in which the base portion is a one-piece construction and wherein the wire connectors are snap-fit into recesses of the base.

It is still a further object of the present invention to provide an electrical disconnect for an appliance in which the wire connectors are enclosed in the base to prevent contact with live parts in both the on or off position.

It is another object of the present invention to provide an electrical disconnect for use with an appliance in which the make/break contacts of the pull-out portion engage adjacent sides of the wire connectors for the load and line, respectively.

It is yet a further object of the present invention to provide an electrical disconnect in which the base comprises an insulative material, the base further including a plurality of tapered wire guides for guiding the conductors of the load and line into the wire connectors within the base of the electrical disconnect.

It is yet another object of the present invention to provide an electrical disconnect for use with an appliance in which the tapered wire guides provide shielding to insulate the stripped portion of the conductors so that no live conductors are exposed and potential shock hazard is avoided.

It is another object of the present invention to include an enclosure in which the electrical disconnect for use with an appliance is mounted. The enclosure includes a series of knockouts to allow entry of the conductors therein and, each knockout includes a slot therein to allow for ease of removal of the knockout with a standard flat blade screwdriver.

In accordance with one form of the present invention, an electrical disconnect for use with an appliance includes a base assembly and a pull-out head assembly. The base assembly comprises an insulative housing having recesses therein and at least one load and at least one line wire connector mounted within the recesses of the housing. The housing further includes wire guides which extend through the housing and are in communication with a conductor receiving space of an associated wire connector. The head assembly includes an insulative body and at least one contact extending from a portion of said body. Upon insertion of the at least one contact of the head assembly into the base assembly, the at least one contact electrically mates the at least one load wire connector to the at least one line wire connector providing power to said appliance. Upon removal of the head assembly from the base assembly, power is disconnected.

In a preferred embodiment, the at least one load wire connector is positioned adjacent the at least one line wire connector forming a contact receiving space therebetween. Specifically, the contact receiving space is defined by substantially parallel conductive walls of the at least one load and line wire connectors, respectively. The at least one contact of the head assembly is preferably substantially U-shaped such that the legs of the contact are biased outwardly to engage the conductive walls of the at least one load and line wire connectors placing them in electrical engagement. The base assembly may also include at least one equipment ground wire connector for coupling an equipment or system ground thereto.

The wire guides of the base assembly are preferably elongate having an axial bore therethrough in communication with the conductor receiving space of the wire connectors. The wire guides are preferably frustoconically shaped such that the larger opening is at a conductor insertion end of the base assembly. The frustoconical shape of the wire guide assists in guiding the conductor into the conductor receiving space of the wire connector. Additionally, the elongate wire guide provides a shield over the portion of the conductor from which the conductor insulation has been stripped to prevent any shock hazard therefrom. Accordingly, exposed live portions of the electrical disconnect are kept at a minimum since the wire connectors are mounted within recesses of the housing and exposed portions of the conductors are enclosed within the wire guides of the base assembly.

The head assembly may also include a guide for aligning the head assembly for positioning within the base assembly. The head assembly includes a top portion having a handle means such that the head assembly may be easily grasped and either inserted or withdrawn from the base assembly. The base assembly may be either a one-piece construction in which the wire connectors are snap-fit into the recesses of the housing or, alternatively, the housing may be formed from at least two sections which are joined together to enclose the wire connectors therebetween.

The electrical disconnect may further include an enclosure for mounting the disconnect. The enclosure may include a plurality of knockouts so that, depending upon the positioning of the conductors, easy access into the enclosure is available. The knockouts are formed having a slot therein to provide for easy removal of the knockout with a standard flat blade screw driver. Typically, the enclosure and electrical disconnect mounted therein is mounted in the vicinity of the appliance so that the appliance may be electrically isolated for maintenance and repair. This is especially useful for appliances such as commercial air conditioners which are generally mounted on a roof top and the power feed originates from a basement of the building. Accordingly, maintenance and repair may be accomplished conveniently at the unit with complete safety from shock hazards.

A preferred form of the electrical disconnect, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
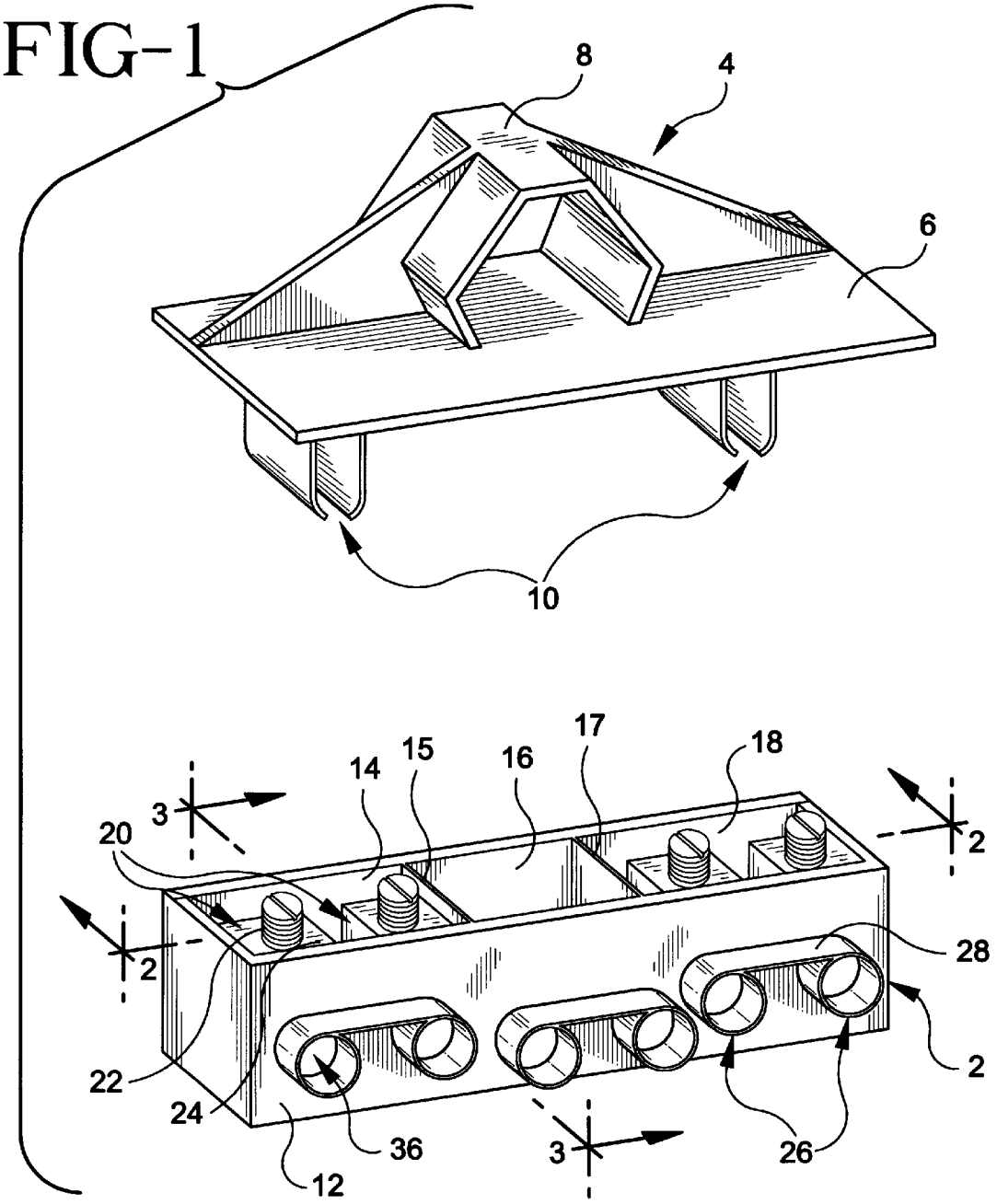
FIG. 1 is a side perspective view of electrical disconnect of the present invention shown with the pull-out head assembly lifted off the base assembly. i.e., the "off" position.

Referring to FIG. 1, an electrical disconnect formed in accordance with the present invention includes a base assembly 2 and a head assembly 4. The head assembly 4 includes an insulative body 6 having a top portion and a bottom portion. Projecting upwardly from the top portion is a handle or grip 8 for easily grasping the head assembly. Projecting downwardly from the lower surface of the body 6 are a pair of electrical contacts 10 which are substantially U-shaped such that the open legs of each contact extend downwardly from the bottom surface of the body of the head assembly.

The base assembly 2 includes an insulative housing 12 having three recesses 14, 16, 18 formed therein. Each of these recesses or compartments 14, 16, 18 are separated by an insulative housing wall 15, 17, respectively. Two compartments 14, 18 include a pair of wire connectors 20 positioned therein. The third compartment 16 includes a pair of ground wire connectors electrically coupled by a bus bar. An equipment and a system ground may be coupled to the ground wire connectors, respectively. In the embodiment shown in FIG. 1, the housing is a one-piece construction and the wire connectors 20 are snap-fit into the recesses 14, 18, respectively. Each wire connector includes a set screw 22 and a conductive housing 24.

The base assembly 2 also includes a plurality of wire guides 26. The wire guides 26 are substantially elongate having an axial bore 36 therethrough communicating with a conductor receiving space 32 (FIG. 3) of an associated wire connector 20.

As shown in FIG. 1, the wire guides associated with each compartment 14, 16, 18 include a shield 28 extending across the top portions of two adjacent wire guides. An object of the invention is to provide an electrical disconnect having no exposed live parts. The wire guides and shields electrically insulate the bare conductors which may be positioned therein.

Figure 2:
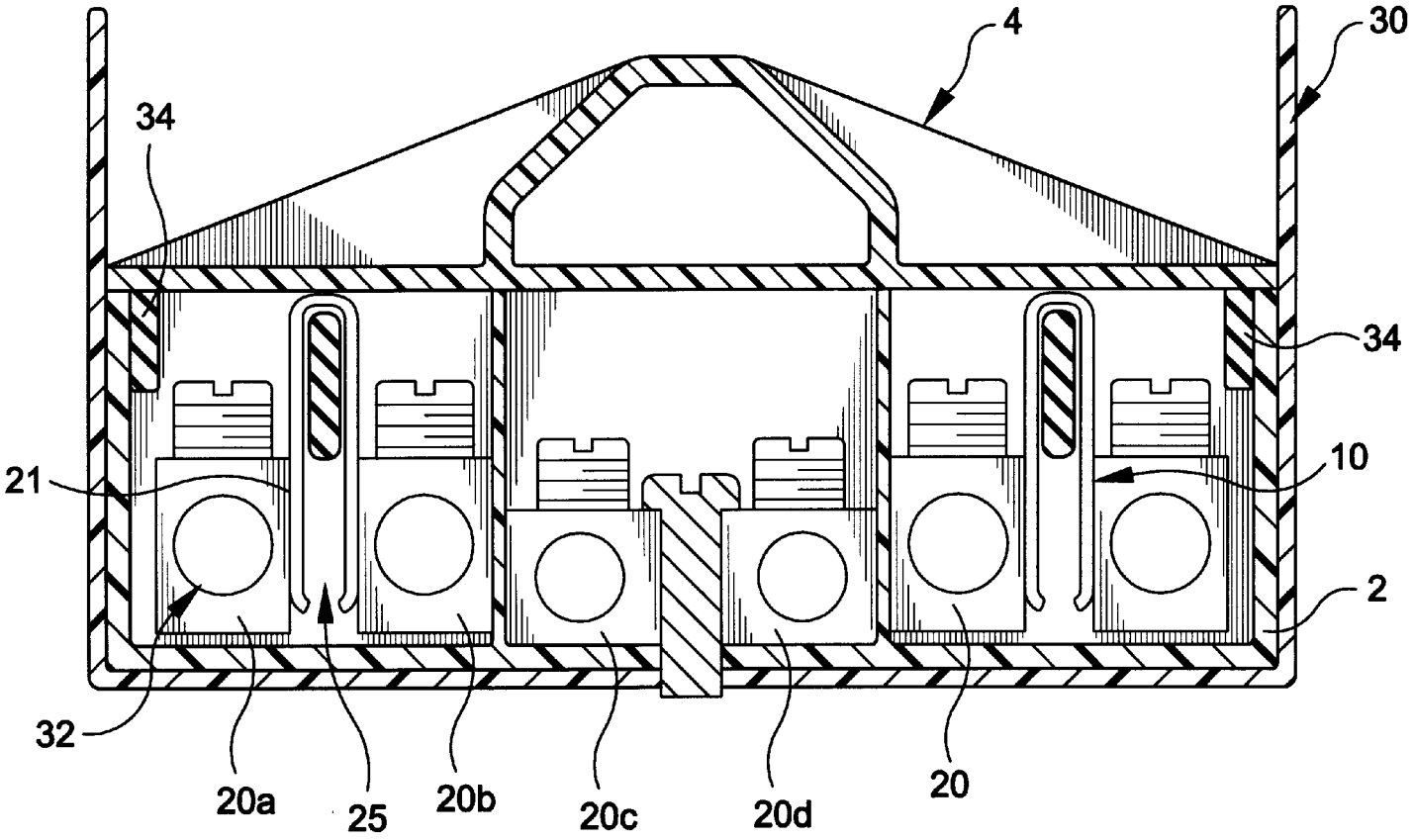
FIG. 2 is a cross-sectional view taken along line 2—2 of FIG. 1 of the electrical disconnect with the head assembly and base assembly coupled together, i.e., the "on" position.

Referring to FIG. 2, the electrical disconnect formed in accordance with the present invention is shown positioned within an enclosure 30. The enclosure 30 may be any suitable metallic or plastic enclosure for housing the electrical disconnect of the present invention. As shown in FIG. 2, the head assembly 4 is in the on position, i.e., positioned within the base assembly 2 so that electrical communication is being made between the wire connectors within a respective compartment. More specifically, the wire connectors, e.g., wire connector 20*a* and wire connector 20*b* are arranged so that a contact receiving space 25 is formed therebetween. Upon insertion of the head assembly 4 into the base assembly 2, the contacts 10 associated with the head assembly engage the substantially flat side walls 21 of the load wire connector 20*a* and the line wire connector 20*b* forming one of the control receiving spaces. In the preferred embodiment, the base assembly 2 includes two sets of wire connectors forming a pair of contact receiving spaces. The contact receiving spaces are longitudinally spaced in the base assembly to be in alignment with the longitudinally spaced contacts 10 of the head assembly. Accordingly, power from the load conductor (not shown) within the load wire connector 20*a* is provided through the contact 10 to the line conductor (not shown) via the line wire connector 20*b*. Thus, an appliance, such as an air conditioning unit, may be provided power.

Each of the wire connectors 20 include a conductor receiving space 32. The opening of the conductor receiving space 32 is capable of receiving conductors from #4 to #14 AWG. FIG. 2 also illustrates equipment ground wire connectors 20*c* and 20*d* for connecting a system ground to an equipment ground. Also shown on FIG. 2 are a pair of guides 34 for aligning the head assembly 4 for positioning within the base assembly 2.

Figure 3:
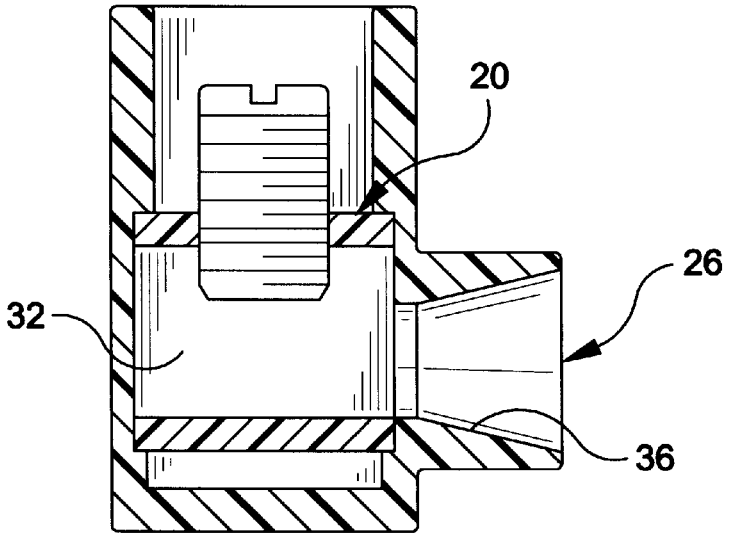
FIG. 3 is a cross-sectional view of the base assembly taken along line 3—3 of FIG. 1.

Referring to FIG. 3, a cross-sectional view of a wire connector 20 and associated wire guide 26 are illustrated. The wire guide 26 includes an axial bore therethrough so that the bore is in communication with the conductor receiving portion 32 of the wire connector 20. In order to facilitate insertion of the conductor into the wire connector, the bore of the wire guide is tapered to form a substantially frustoconically shaped bore 36. Naturally, the bore has its wider opening at the conductor insertion end of the wire guide and tapers into the conductor receiving portion of the wire connector. Furthermore, the construction of the base assembly 2 provides for insulating all live portions of the electrical disconnect from being exposed. Specifically, the wire connectors 20 are recessed within the insulative housing of the base assembly 2 and the wire guides 26 which project perpendicularly from a front wall of the housing allow for the exposed conductor portion to be fully enclosed within the wire guide thereby protecting users from potential shock hazard.

Figure 4:
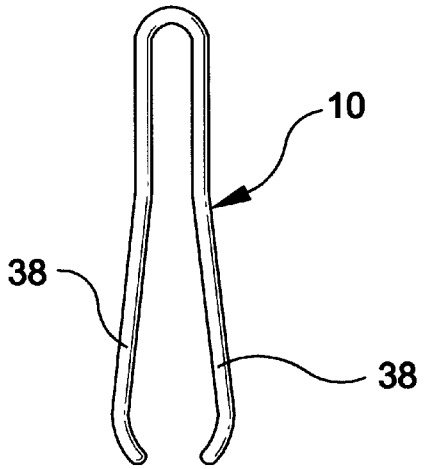
FIG. 4 is a side elevational view of an electrical contact of the head assembly.

Referring to FIG. 4, the contact 10 of the head assembly 4 is shown. The contact 10 is substantially U-shaped having two legs which extend downwardly for insertion into the contact receiving space 25 within the base assembly. The legs 38 are biased outwardly to provide for good electrical contact between the conductive walls 21 of the wire connectors. The contact 10 is formed from an electrically conductive material to provide for electrical transfer of power from the load source to the equipment.

Figure 5:
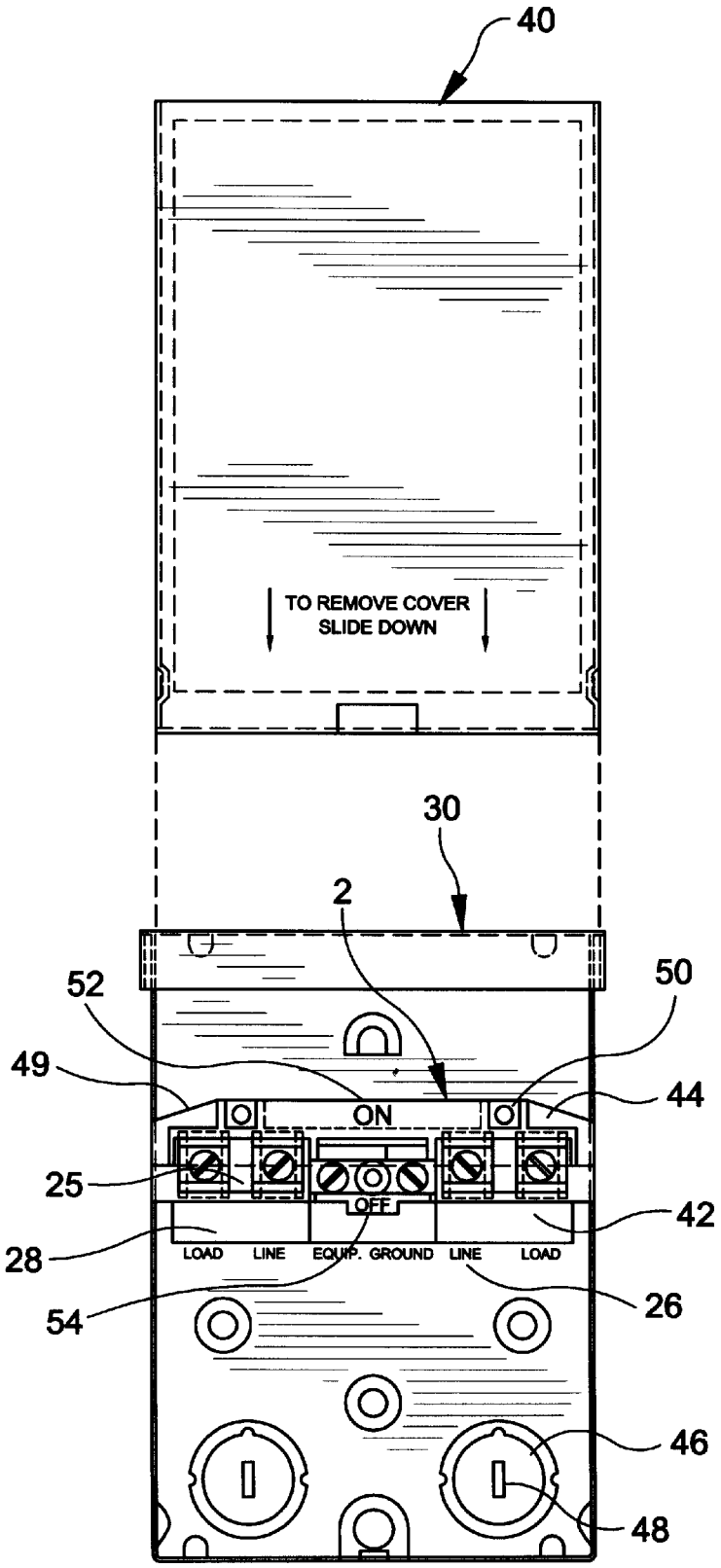
FIG. 5 is a top elevational view of the base assembly of the electrical disconnect formed in accordance with the present invention mounted within an enclosure and the associated top of the enclosure.

Referring now to FIG. 5, the base 2 of the electrical disconnect of the present invention is shown mounted within the bottom portion of the enclosure 30. The enclosure cover 40 is slidably positionable over the enclosure bottom to enclose the electrical disconnect therein. The base assembly 2 of the electrical disconnect shown in FIG. 5 is a two-piece construction such that the wire connectors are positioned between a front section and back section 42, 44, respectively, of the base assembly. The base assembly 2 includes an upper portion 49 extending in an opposite direction from the wire guides 26. The upper portion of the base assembly includes a pair of channels 50 formed therein also being longitudinally spaced apart the same distance as the contacts 10 of the head assembly. In the preferred embodiment shown in FIG. 5, the channels 50 and contact receiving spaces 25 are substantially axially aligned on the base assembly. The channels 50 are insulated from the load and line wire connectors by a wall of the housing. As illustrated in FIG. 5, the top surface of the base assembly includes the words "on" 52 and "off" 54. Upon removal of the head assembly contacts from the base assembly contact receiving spaces, the head assembly contacts may be placed to reside in the channels 50 and no current can pass from the line to the load. Furthermore, the compartments 14, 16, 18 are substantially covered by the head assembly in this position. As shown in FIG. 5, the enclosure 30 includes a series of knockouts 46, each knockout having a slot 48 formed therein. The slot 48 is provided substantially in the center of the knockout 46 for ease of removal of the knockout using a standard flat blade screw driver.

The present invention as described and shown in the drawings is simple, easy to manufacture and provides for a mechanical disconnect which can be located near an appliance or piece of equipment which may be of substantial distance from an electrical breaker or fuse. The design of the present invention including the wire connectors being positioned within recesses of an insulative body and the unique wire guides prevents contact with live portions of the disconnect both in the on and off position, i.e., with the head assembly inserted or removed, respectively. Furthermore, the present invention provides for the make/break contacts of the head assembly to engage a side wall of the wire connectors directly to electrically connect the line to the load. Furthermore, the tapered wire guides provide for ease of installation of conductors into the electrical disconnect and also to enclose any exposed portion of the conductors within the wire guide to prevent electrical shock. Accordingly, the present invention provides for an improved non-fused electrical disconnect for use with appliances or equipment such as roof top air conditioners which are located a substantial distance from the load source circuit breakers. Accordingly, this manual disconnect allows maintenance and repair of equipment to be completed safely without the risk of electrical shock.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical disconnect for use with an appliance, comprising:

a singular base assembly, the base assembly including an insulative housing having a front wall and at least two load and at least two line wire connectors each having a conductor receiving space therein and wherein the load and line wire connectors are positioned adjacent each other forming a pair of contact receiving spaces therebetween, each pair of wire connectors being mounted within discrete recesses of said housing separated by at least one insulative wall member, the housing further including at least four wire guides each of which extend through the front wall of the housing in communication with the conductor receiving spaces of the wire connectors; and a pull-out head assembly, the head assembly including an insulative body and at least two contacts extending from a portion of said body, wherein upon insertion of the head assembly into the base assembly, the at least two contacts of the head assembly electrically mate the at least two load wire connectors to the at least two line wire connectors providing power to said appliance and upon removal of the head assembly contacts from said base assembly wire connectors, power is disconnected.

2. The electrical disconnect as defined in claim 1, wherein the contact receiving space is defined by substantially parallel conductive walls of the load and line wire connectors.

3. The electrical disconnect as defined in claim 2, wherein each of the contacts of the head assembly are substantially U-shaped such that the legs of the contacts are biased outwardly to engage the conductive walls of the load and line wire connectors.

4. The electrical disconnect as defined in claim 1, wherein the wire guides are frustoconically shaped to guide a conductor into a conductor receiving space of the wire connector.

5. The electrical disconnect as defined in claim 4, wherein the wire guide projects outwardly from the housing front wall so that any bare portion of a conductor placed therein is substantially enclosed to prevent shock hazard.

6. The electrical disconnect as defined in claim 1, further including at least one ground wire connector mounted within a separate discrete recess of said housing separated from the other discrete recesses by at least one insulative wall member and having an associated wire guide extending through the housing in communication with a conductor receiving space of said wire connector.

7. The electrical disconnect as defined in claim 1, further comprising an enclosure in which the base assembly is mounted, the enclosure including at least one knockout, the knockout including a slot formed in a section thereof for receiving a tool to aid in removal of the knockout from the enclosure.

8. The electrical disconnect as defined in claim 1, wherein the appliance is an air conditioner.

9. The electrical disconnect as defined in claim 1, wherein the insulative housing comprises at least two sections joined together.

10. The electrical disconnect as defined in claim 1, wherein the head assembly includes a guide for aligning the head assembly for positioning on said base assembly.

11. An electrical disconnect as defined in claim 1, wherein the base assembly is a one-piece construction and the wire connectors are snap-fit into the recesses of said housing.

12. An electrical disconnect for use with an appliance, comprising:

a singular insulative housing having two pair of load and line wire connectors positioned to provide a contact receiving space between each load and line wire connector, the housing including a wire guide associated with each wire connector, the wire guides extending through said housing and communicating with a respective conductor receiving space, the housing further including an upper portion having a pair of spaced channels therein, the channels being spaced the same longitudinal distance as said contact receiving spaces in the housing and being insulated from the load and line wire connectors; and an insulative body having a pair of contacts projecting therefrom, said contacts being longitudinally spaced the same distance as the contact receiving spaces in the housing for placement therein, wherein upon insertion of the body into the housing, the contacts electrically couple the load wire connector to the line wire connector providing power to an appliance and upon removal of the contacts from the contact receiving spaces of the housing, power is disconnected, and further wherein the channels are dimensioned for receiving the contacts and holding the insulative body when power is disconnected.

13. The electrical disconnect as defined in claim 12, wherein the contact receiving space is defined by substantially parallel conductive walls of the load and line wire connectors respectively.

14. The electrical disconnect as defined in claim 12, wherein the wire guide is substantially frustoconically shaped to guide a conductor in the conductor receiving space of the wire connector.

15. The electrical disconnect as defined in claim 12, wherein each of the wire guides extend through and project outwardly from a front wall such that any bare portion of a conductor placed therein is substantially enclosed to prevent shock hazard.

16. An electrical disconnect for use with an appliance, comprising:

a singular base assembly, the base assembly including an insulative housing and a plurality of wire connectors within discrete compartments of said housing having an insulating wall therebetween, each wire connector having a conductor receiving space, the housing further including a plurality of wire guides substantially linearly aligned, each wire guide having an axial bore extending through and projecting outwardly from a front wall of the housing in communication with an associated conductor receiving space of the wire connector, the wire guide providing an insulative shield for bare conductor portions placed therein, the housing including at least two discrete compartments, each discrete insulated compartment having therein a load and a line wire connector forming a contact receiving space therebetween; and a pull-out head assembly, the head assembly including an insulative body and at least two contacts extending from a portion thereof, wherein upon insertion of the head assembly into the base assembly, the at least two contacts of the head assembly electrically couples the wire connectors within each of the discrete insulated compartments for providing power to the appliance and upon removal of said head assembly contacts from said base assembly contact receiving spaces, power is disconnected.

17. The electrical disconnect as defined in claim 16, wherein the load wire connector wire guide and adjacent line wire connector wire guide include an insulative shield therebetween.

18. The electrical disconnect as defined in claim 17, wherein the contact receiving space is defined by substantially parallel conductive walls of the load and line wire connectors, and wherein the at least one contact of the head assembly engages the conductive walls to provide electrical communication between the load and line wire connectors.

* * * * *